US009175652B2

(12) United States Patent
Pauer et al.

(10) Patent No.: US 9,175,652 B2
(45) Date of Patent: Nov. 3, 2015

(54) FUEL INJECTION DEVICE

(75) Inventors: Thomas Pauer, Freiberg (DE); Andreas Rettich, Herrenberg-Kuppingen (DE); Markus Rueckle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 401 days.

(21) Appl. No.: 13/262,835

(22) PCT Filed: Mar. 12, 2010

(86) PCT No.: PCT/EP2010/053168

§ 371 (c)(1),
(2), (4) Date: Dec. 27, 2011

(87) PCT Pub. No.: WO2010/112317

PCT Pub. Date: Oct. 7, 2010

(65) Prior Publication Data

US 2012/0090577 A1 Apr. 19, 2012

(30) Foreign Application Priority Data

Apr. 2, 2009 (DE) ..... 10 2009 002 128

(51) Int. Cl.
*B05B 1/30* (2006.01)
*F02M 51/00* (2006.01)
(Continued)

(52) U.S. Cl.
CPC ..... *F02M 55/002* (2013.01); *F02M 47/027* (2013.01); *F02M 51/005* (2013.01)

(58) Field of Classification Search
CPC ..... F02M 47/027; F02M 51/005; F02M 2457/003; F02M 55/002; F02M 63/0017; F02M 39/00; F02M 55/008; F02M 51/0657; F02M 51/0682; F02M 51/0675; F02F 7/006
USPC ..... 123/41.31, 446, 447, 456, 458, 467, 123/468, 469, 470, 472, 476, 490, 498, 499, 123/514, 531; 239/88, 89, 96, 533.1, 533.2, 239/533.8, 533.9, 585.1–585.4, 124; 251/36, 47, 129.01, 129.07, 129.15, 251/129.17, 129.18; 285/133.11, 305, 320
See application file for complete search history.

(56) References Cited

U.S. PATENT DOCUMENTS 2,621,875 A * 12/1952 Darling ..... 244/122 A
3,610,529 A * 10/1971 Huber ..... 239/96
(Continued)

FOREIGN PATENT DOCUMENTS

CN 101397963 4/2009
DE 3105685 9/1982
(Continued)

OTHER PUBLICATIONS

PCT/EP2010/053168 International Search Report dated Aug. 3, 2010 (3 pages).

*Primary Examiner* — Stephen K Cronin
*Assistant Examiner* — Brian Kirby
(74) *Attorney, Agent, or Firm* — Michael Best & Friedrich LLP

(57) ABSTRACT

The invention relates to a fuel injection device for injecting fuel into a combustion chamber of an internal combustion engine, comprising an end (6) that is located at a distance from the combustion chamber and has at least one electric connection (33) and at least one return flow connection (40). In order to create a fuel injection device (1) that has a simple design and can be produced cost-effectively, the return flow connection (40) and the electric connection (33) are integrated in a common connecting member.

22 Claims, 2 Drawing Sheets

(51) Int. Cl.
*F02M 55/00* (2006.01)
*F02M 47/02* (2006.01)

(56) References Cited

U.S. PATENT DOCUMENTS

| | | | | | |
|---|---|---|---|---|---|
| 3,614,945 | A | * | 10/1971 | Schlagmuller | 23/179.16 |
| 4,394,973 | A | * | 7/1983 | Sauer et al. | 239/467 |
| 4,471,914 | A | * | 9/1984 | Hafner et al. | 239/585.3 |
| 4,826,080 | A | * | 5/1989 | Ganser | 239/88 |
| 4,826,082 | A | * | 5/1989 | Greiner et al. | 239/113 |
| 4,841,942 | A | * | 6/1989 | McKay | 123/533 |
| 4,870,943 | A | * | 10/1989 | Bradley | 123/558 |
| 4,895,124 | A | * | 1/1990 | Bartholomew | 123/510 |
| 4,938,193 | A | * | 7/1990 | Raufeisen et al. | 123/470 |
| 4,946,103 | A | * | 8/1990 | Ganser | 239/88 |
| 4,993,636 | A | * | 2/1991 | Taue et al. | 239/88 |
| 5,154,350 | A | * | 10/1992 | Ausiello et al. | 239/96 |
| 5,183,209 | A | * | 2/1993 | Ricco et al. | 239/585.1 |
| 5,325,838 | A | * | 7/1994 | Bennett | 123/527 |
| 5,338,163 | A | * | 8/1994 | Frank et al. | 417/410.1 |
| 5,775,301 | A | * | 7/1998 | Ganser | 123/467 |
| 6,027,037 | A | * | 2/2000 | Murakami et al. | 239/88 |
| 6,119,657 | A | * | 9/2000 | Stevens et al. | 123/469 |
| 6,131,540 | A | * | 10/2000 | Bronkal | 123/41.31 |
| 6,131,829 | A | * | 10/2000 | Ricco | 239/585.1 |
| 6,550,699 | B2 | * | 4/2003 | Nagai et al. | 239/585.1 |
| 6,568,369 | B1 | * | 5/2003 | Desai et al. | 123/467 |
| 6,892,706 | B2 | * | 5/2005 | Kienzler et al. | 123/468 |
| 6,974,088 | B2 | * | 12/2005 | Albert et al. | 239/88 |
| 7,175,442 | B2 | * | 2/2007 | Sanftleben et al. | 439/34 |
| 7,475,674 | B2 | * | 1/2009 | Marksteiner et al. | 123/468 |
| 7,637,443 | B2 | * | 12/2009 | Scheffel et al. | 239/585.1 |
| 7,815,131 | B2 | * | 10/2010 | Dick et al. | 239/533.1 |
| 2006/0000931 | A1 | * | 1/2006 | Ricco et al. | 239/585.3 |
| 2011/0212638 | A1 | * | 9/2011 | Junger | 439/190 |

FOREIGN PATENT DOCUMENTS

| | | | | | |
|---|---|---|---|---|---|
| DE | 19717459 | | | 11/1998 | |
| DE | 10025043 | A1 | * | 11/2001 | |
| DE | 10232250 | | | 2/2004 | |
| DE | 10232250 | A1 | * | 2/2004 | F02M 55/00 |
| DE | 102006040248 | | | 3/2008 | |
| DE | 102008043690 | | | 5/2009 | |
| DE | 102008001968 | A1 | * | 12/2009 | H01F 7/126 |
| DE | 102008002720 | A1 | * | 12/2009 | F02M 47/02 |
| FR | WO2008062144 | | * | 5/2008 | F02M 51/00 |
| WO | WO 01/18382 | A1 | * | 3/2001 | |
| WO | 0190567 | | | 11/2001 | |
| WO | 2008062144 | | | 5/2008 | |
| WO | WO 2008062144 | A2 | * | 5/2008 | F02M 51/06 |

* cited by examiner

FUEL INJECTION DEVICE

BACKGROUND OF THE INVENTION

The invention relates to a fuel injection device for injecting fuel into a combustion chamber of an internal combustion engine, having an end remote from the combustion chamber, which end has at least one electrical connection and at least one return connection.

The German laid-open specification DE 31 05 685 A1 discloses a liquid-cooled fuel injection nozzle having a common connection nipple for the discharge of leakage oil and the return of coolant. The German laid-open specification DE 10 2006 040 248 A1 discloses a fuel injection device for a multi-cylinder internal combustion engine having a housing which has two high-pressure connections.

SUMMARY OF THE INVENTION

It is an object of the invention to provide a fuel injection device which is of simple construction and can be produced cheaply.

The object is achieved, in the case of a fuel injection device for injecting fuel into a combustion chamber of an internal combustion engine, having an end remote from the combustion chamber, which end has at least one electrical connection and at least one return connection, in that the return connection and the electrical connection are integrated into a common connection body. According to an essential aspect of the invention, both the return connection and also the electrical connection run through the common connection body. As a result of the combination of the two connections in the common connection body, in particular in the case of longitudinally installed in-line engines, the available installation space under an engine hood of a motor vehicle can be better utilized. Furthermore, by means of the connection body according to the invention, increased demands with regard to pedestrian protection can be more effectively fulfilled. Finally, as a result of the common connection body for the two connections, additional connection pieces can be dispensed with.

A preferred exemplary embodiment of the fuel injection device is characterized in that the return connection and the electrical connection run through the common connection body. The common connection body preferably surrounds the two connections such that injuries to a pedestrian by the connections can be reliably prevented. Furthermore, the structural height of that end of the fuel injection device which is remote from the combustion chamber can be reduced as a result of the common connection body.

A further preferred exemplary embodiment of the fuel injection device is characterized in that the return connection and the electrical connection are partially extrusion-coated with plastic material. The return connection is preferably extrusion-coated with the same plastic material as that used for the extrusion coating of electrical connections.

A further preferred exemplary embodiment of the fuel injection device is characterized in that the fuel injection device comprises a magnet assembly which is at least partially extrusion-coated with plastic material together with the return connection and the electrical connection. The magnet assembly comprises for example a magnet actuator which interacts in a known way with a magnet coil to which the electrical connection is assigned.

A further preferred exemplary embodiment of the fuel injection device is characterized in that the return connection runs through a support plate which constitutes a closure on that end of the fuel injection device which is remote from the combustion chamber. The support plate serves preferably to support a guide pin for the magnet armature of the magnet assembly in the axial direction on that end of the fuel injection device which is remote from the combustion chamber. The support plate may be fully or partially extrusion-coated with plastic material.

A further preferred exemplary embodiment of the fuel injection device is characterized in that, radially outside an inner support point of the support plate, at least one return duct extends from a return chamber in the fuel injection device. The guide pin described above may be supported on the inner support point. The return duct serves to discharge, for example, leakage and/or a cooling medium in the form of fuel at low pressure from the interior of the fuel injection device. The return duct may be joined to a fuel storage tank outside the fuel injection device.

A further preferred exemplary embodiment of the fuel injection device is characterized in that, radially outside an inner support point of the support plate, a plurality of return ducts extend from a return chamber in the fuel injection device, which return ducts open into a central return joining duct. In the common connection body, the return may have, viewed in longitudinal section, for example the shape of an upsilon with two limbs which extend from the return chamber in the interior of the fuel injection device and which open into the central return joining duct.

A further preferred exemplary embodiment of the fuel injection device is characterized in that a return connection duct which runs perpendicular to a longitudinal direction of the fuel injection device extends from the return duct or from the return joining duct. The return is of substantially L-shaped design in the common connection body.

A further preferred exemplary embodiment of the fuel injection device is characterized in that two return connection ducts which run perpendicular to a longitudinal direction of the fuel injection device extend from the return duct or from the return joining duct. The return is of substantially T-shaped design in the common connection body.

A further preferred exemplary embodiment of the fuel injection device is characterized in that, at the inner support point, a guide pin and/or a spring device are/is supported at the inside on the support plate. The spring device comprises for example a helical compression spring by means of which the magnet armature of the magnet assembly is preloaded in the direction of the combustion chamber. The spring device may furthermore comprise a plate spring which exerts a preload force on a magnet actuator.

Further advantages, features and details of the invention will emerge from the following description, which describes an exemplary embodiment in detail with reference to the drawing.

DETAILED DESCRIPTION

Figure 1:
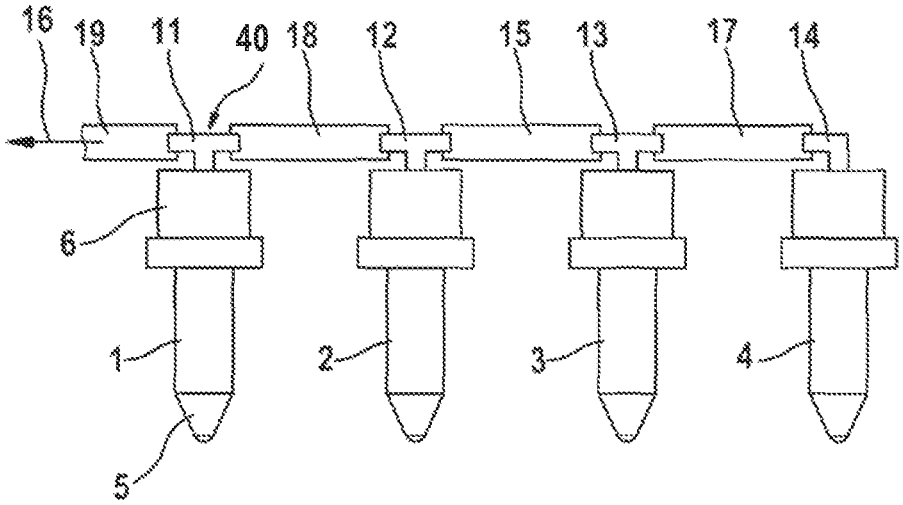
FIG. 1 shows a highly simplified illustration of a detail of a fuel injection system having four fuel injection devices connected in series.

Four fuel injection devices 1 to 4 connected in series are illustrated in highly simplified form in FIG. 1. The fuel injection devices 1 to 4 comprise in each case an end 5 which is close to the combustion chamber and from which fuel at high pressure is injected into associated combustion chambers of an internal combustion engine. The fuel injection devices 1 to 4, which are also referred to as fuel injectors, also have in each case one end 6 remote from the combustion chamber, which end 6 is connected via a return connection 40 to a return.

The return connections of the fuel injection devices 1 to 3 are designed in each case as a T-piece 11, 12, 13. The return connection of the fuel injection device 4 is designed as an L-piece 14. The two T-pieces 12 and 13 are joined to one another via a joining line 15. The T-piece is joined via a further joining line 17 to the L-piece 14. The two T-pieces 11 and 12 are joined to one another via a joining line 18. Furthermore, a joining line 19 extends from the T-piece 11 to a return collecting chamber indicated by an arrow 16.

The fuel injection device only partially illustrated in FIG. 1 is designed preferably for a multi-cylinder internal combustion engine, preferably an auto-ignition internal combustion engine, of a motor vehicle. The fuel injection device comprises, aside from the illustrated fuel injection devices 1 to 4, at least one high-pressure pump by means of which fuel is delivered at high pressure.

Each cylinder of the internal combustion engine is assigned one of the fuel injection devices 1 to 4, which are also referred to as injectors and through which the fuel can be injected into the combustion chamber of the associated cylinder. The highly pressurized fuel is supplied to the fuel injection devices 1 to 4 via fuel high-pressure lines. The actuation of the fuel injection devices 1 to 4 is realized preferably electrically via electrical connection lines.

Figure 2:
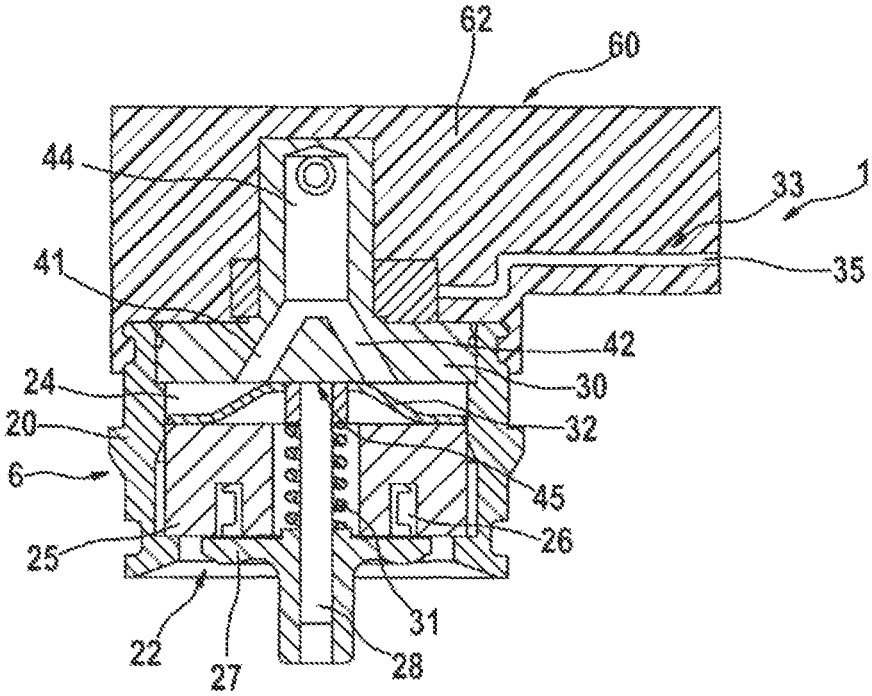
FIG. 2 shows an enlarged and more detailed illustration of that end of one of the fuel injection devices from FIG. 1 which is remote from the combustion chamber, in longitudinal section.
Figure 3:
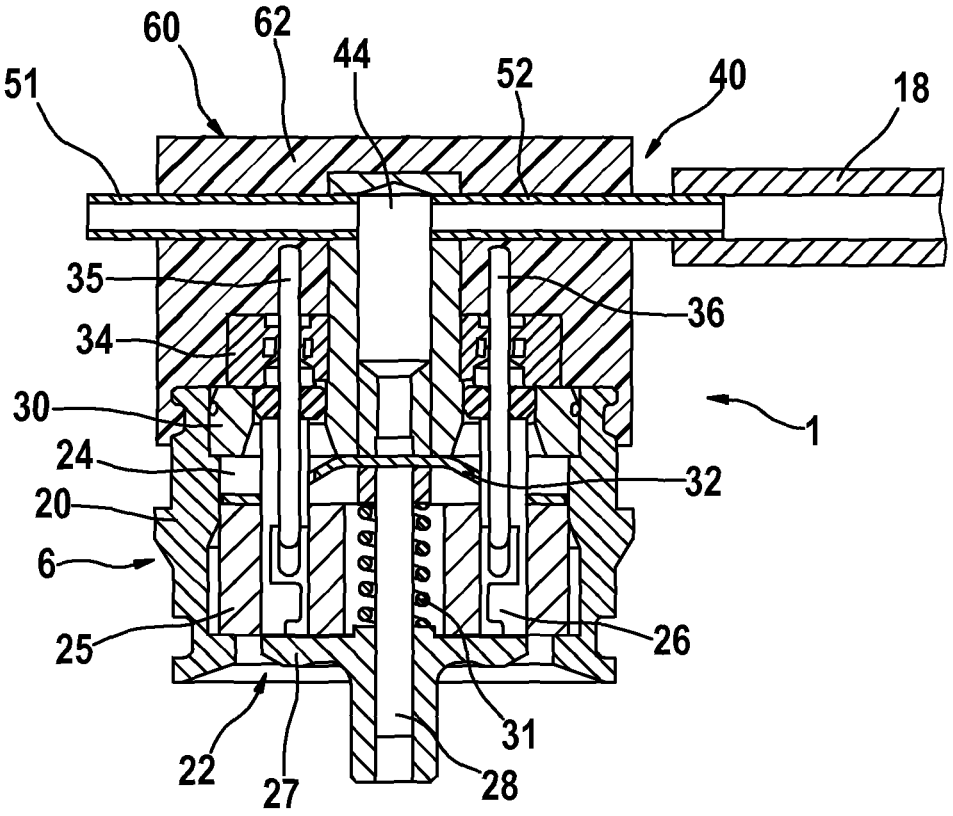
FIG. 3 shows a longitudinal section, rotated through 90°, of that end of the fuel injection device from FIG. 2 which is remote from the combustion chamber.

In FIGS. 2 and 3, that end 6 of the fuel injection device 1 which is remote from the combustion chamber is illustrated on an enlarged scale in two different longitudinal sectional views. The fuel injection device 1 comprises a housing body 20 which may be of single-part or multi-part design. In that end of the housing body 20 which is remote from the combustion chamber, a magnet assembly 22 is accommodated in a return pressure chamber 24.

The magnet assembly 22 comprises a magnet actuator 25 with a magnet coil 26 which interacts with a magnet armature 27. The magnet armature 27 is guided by means of a guide pin 28 such that it can move away from the magnet coil 26 and towards the magnet coil 26. The guide pin 28 is supported on a support plate 30 which delimits the return pressure chamber 24 in the axial direction. The return pressure chamber 24 is delimited in the radial direction by the housing body 20.

The magnet armature 27 is preloaded away from the magnet coil 26 by a helical compression spring 31 through which the guide pin 28 extends. The magnet actuator 25 with the magnet coil 26 is preloaded away from the support plate 30 by a plate spring 32 and is actuated via an electrical connection 33.

As can be seen in FIG. 3, two electrical connection elements 35, 36 extend from the magnet coil 26 of the magnet assembly 22, which connection elements extend through an electrical connection piece 34 into a connection body 60 which is formed from plastic material 62 in which that end 6 of the fuel injection device 1 which is remote from the combustion chamber is extrusion-coated. It can be seen in FIG. 2 that the connection element 35, at its end, extends perpendicular to the longitudinal direction of the fuel injection device 1.

Two return ducts 41, 42 extend from the return chamber 24, which return ducts open into a common return joining duct 44 of a return connection 40. The return ducts 41, 42 extend, radially outside a support point 45 for the guide pin 28, through the support plate 30 in such a way that, together with the return joining duct 44, they form in longitudinal section an upsilon which is upside-down in FIG. 2.

The return joining duct 44 opens at its end remote from the combustion chamber into the connection body 60 through which the two electrical connection elements 35 and 36 also extend. Two transversely running return connection ducts 51, 52, in the form of line pieces in the illustrated example, extend through the plastic material 62 which forms the connection body 60 from that end of the return joining duct 44 which is remote from the combustion chamber. Connected to the return connection duct 51 is the joining line 18. The exemplary embodiment illustrated in FIG. 3, with the two return connection ducts 51, 52, constitutes a T-piece. Alternatively, an L-piece may be analogously formed by means of only one of the return connection ducts 51, 52.

According to an essential aspect of the invention, the return connection 40 is integrated directly into the magnet group extrusion coating. For this purpose, a return connection piece may be welded to the support plate and subsequently extrusion-coated with plastic material. The invention also encompasses an embodiment composed entirely of plastic, wherein the connection piece, for example in the form of a T-piece or L-piece, is plugged into the support plate 30 and sealed by means of an O-ring and subsequently extrusion-coated. Furthermore, the return connection may be integrated into an extrusion-coating die by means of which that end of the fuel injection device which is remote from the combustion chamber is extrusion-coated.

What is claimed is:

1. A fuel injection device for injecting fuel into a combustion chamber of an internal combustion engine, the device comprising:

an end (6) remote from the combustion chamber, which end (6) has at least one electrical connection (33) and at least one return connection (40), the return connection (40) and the electrical connection (33) being integrated into a common connection body (60); and a housing body (20) coupled to the common connection body (60), the common connection body (60) comprised of plastic material (62), with the end (6) of the fuel injection device (1) remote from the combustion chamber (6) being encapsulated in the common connection body (60), and the at least one return connection (40) runs through a support plate (30) which defines a connection on the end (6) of the fuel injection device (1) remote from the combustion chamber, wherein the support plate 30 is disposed in the housing body (20), wherein at least one return duct (40, 41) extends through the support plate (30), wherein a return chamber 24 is disposed axially from the support plate (30) along a direction extending from the support plate (30) toward the combustion chamber, the return chamber (24) disposed axially between the support plate (30) and a magnet actuator (25) such that at all times, the magnet actuator (25) is spaced at all points axially from the support plate (30), and wherein the return chamber (24) disposed entirely in the housing body (20).

2. The fuel injection device as claimed in claim 1, characterized in that the return connection (40) and the electrical connection (33) run through the common connection body (60).

3. The fuel injection device as claimed in claim 1, characterized in that the return connection (40) and the electrical connection (33) are partially extrusion-coated with plastic material (62).

4. The fuel injection device as claimed in claim 1, characterized in that the fuel injection device (1) comprises a magnet assembly (22) which is at least partially extrusion-coated with plastic material (62) together with the return connection (40) and the electrical connection (33).

5. The fuel injection device as claimed in claim 1, characterized in that, radially outside an inner support point (45) of the support plate (30), at least one return duct (41, 42) extends from the return chamber (24) in the fuel injection device (1).

6. The fuel injection device as claimed in claim 1, characterized in that, radially outside an inner support point (45) of the support plate (30), a plurality of return ducts (41, 42) extend from the return chamber (24) in the fuel injection device (1), which return ducts open into a central return joining duct (44).

7. The fuel injection device as claimed in claim 6, characterized in that a return connection duct (51, 52) which runs perpendicular to a longitudinal direction of the fuel injection device (1) extends from the return duct (41, 42) or from the central return joining duct (44).

8. The fuel injection device as claimed in claim 5, characterized in that two return connection ducts (51, 52) which run perpendicular to a longitudinal direction of the fuel injection device (1) extend from the return duct (41, 42) or from the return joining duct (44).

9. The fuel injection device as claimed in claim 5, characterized in that, at the inner support point (45), one of a guide pin (28) and a spring device is supported at the inside on the support plate (30).

10. The fuel injection device as claimed in claim 6, characterized in that a return connection duct (51, 52) which runs perpendicular to a longitudinal direction of the fuel injection device (1) extends from the return duct (41, 42) or from the return joining duct (44).

11. The fuel injection device as claimed in claim 6, characterized in that two return connection ducts (51, 52) which run perpendicular to a longitudinal direction of the fuel injection device (1) extend from the return duct (41, 42) or from the return joining duct (44).

12. The fuel injection device as claimed in claim 2, characterized in that the return connection (40) and the electrical connection (33) are partially extrusion-coated with plastic material (62).

13. The fuel injection device as claimed in claim 12, characterized in that the fuel injection device (1) comprises a magnet assembly (22) which is at least partially extrusion-coated with plastic material (62) together with the return connection (40) and the electrical connection (33).

14. The fuel injection device as claimed in claim 13, characterized in that the return connection (40) runs through a support plate (30) which constitutes a connection on that end (6) of the fuel injection device (1) which is remote from the combustion chamber.

15. The fuel injection device as claimed in claim 14, characterized in that, radially outside an inner support point (45) of the support plate (30), at least one return duct (41, 42) extends from a return chamber (24) in the fuel injection device (1).

16. The fuel injection device as claimed in claim 14, characterized in that, radially outside an inner support point (45) of the support plate (30), a plurality of return ducts (41, 42) extend from a return chamber (24) in the fuel injection device (1), which return ducts open into a central return joining duct (44).

17. The fuel injection device as claimed in claim 15, characterized in that a return connection duct (51, 52) which runs perpendicular to a longitudinal direction of the fuel injection device (1) extends from the return duct (41, 42) or from the return joining duct (44).

18. The fuel injection device as claimed in claim 16, characterized in that a return connection duct (51, 52) which runs perpendicular to a longitudinal direction of the fuel injection device (1) extends from the return duct (41, 42) or from the return joining duct (44).

19. The fuel injection device as claimed in claim 15, characterized in that two return connection ducts (51, 52) which run perpendicular to a longitudinal direction of the fuel injection device (1) extend from the return duct (41, 42) or from the return joining duct (44).

20. The fuel injection device as claimed in claim 16, characterized in that two return connection ducts (51, 52) which run perpendicular to a longitudinal direction of the fuel injection device (1) extend from the return duct (41, 42) or from the return joining duct (44).

21. The fuel injection device as claimed in claim 1, wherein the return chamber (24) is disposed axially between the support plate (30) and an armature (27), and wherein the armature (27) is disposed axially from the return chamber (24) along a direction extending from the return chamber (24) toward the combustion chamber.

22. The fuel injection device as claimed in claim 1, further comprising a spring (32) disposed within the return chamber (24) and in contact with both the support plate (30) and the magnet actuator (25).

* * * * *